US010564562B2

(12) United States Patent
Ron et al.

(10) Patent No.: US 10,564,562 B2
(45) Date of Patent: Feb. 18, 2020

(54) PRIMING A PRINT SUBSTRATE

(71) Applicant: HP Indigo B.V., Amstelveen (NL)

(72) Inventors: Hannoch Ron, Kadima (IL); Yaron Hershman, Gedera (IL); Gleb Romantcov, Nes Ziona (IL); Peter Nedelin, Ashdod (IL); Guy Nesher, Nes Ziona (IL)

(73) Assignee: HP Indigo B.V., Amstelveen (NL)

( * ) Notice: Subject to any disclaimer, the term of this patent is extended or adjusted under 35 U.S.C. 154(b) by 65 days.

(21) Appl. No.: 15/770,139

(22) PCT Filed: Dec. 11, 2015

(86) PCT No.: PCT/EP2015/079394
§ 371 (c)(1),
(2) Date: Apr. 20, 2018

(87) PCT Pub. No.: WO2017/097371
PCT Pub. Date: Jun. 15, 2017

(65) Prior Publication Data
US 2018/0314191 A1 Nov. 1, 2018

(51) Int. Cl.
*G03G 9/12* (2006.01)
*G03G 9/13* (2006.01)
(Continued)

(52) U.S. Cl.
CPC ..... *G03G 9/12* (2013.01); *G03G 7/00* (2013.01); *G03G 7/002* (2013.01); *G03G 7/0006* (2013.01); *G03G 7/006* (2013.01); *G03G 7/008* (2013.01); *G03G 7/0013* (2013.01); *G03G 7/0066* (2013.01); *G03G 7/0073* (2013.01);
(Continued)

(58) Field of Classification Search
CPC ..... G03G 7/00; G03G 7/0006; G03G 7/0013; G03G 7/002; G03G 7/006; G03G 7/0066; G03G 7/0073; G03G 7/008; G03G 9/12; G03G 9/13; G03G 9/131; G03G 9/132;
(Continued)

(56) References Cited

U.S. PATENT DOCUMENTS 9,175,172 B2 11/2015 Regnier
2008/0252680 A1* 10/2008 Schmid ..... B41J 2/04 347/20
(Continued)

FOREIGN PATENT DOCUMENTS

WO WO-2013/126869 8/2013
WO WO-2014/206492 12/2014
(Continued)

OTHER PUBLICATIONS

International Search Report and Written Opinion for International Application No. PCT/EP2015/079394 dated Aug. 5, 2016, 11 pages.

*Primary Examiner* — David M. Gray
*Assistant Examiner* — Geoffrey T Evans
(74) *Attorney, Agent, or Firm* — Dierker & Kavanaugh PC

(57) ABSTRACT

Described herein is a method for priming a print substrate for subsequently receiving a liquid electrophotographic (LEP) inkin which a surface of a print substrate is coated with a first primer using an analogue printing technique and a second primer is digitally printed to the surface of the print substrate coated with the first primer.

16 Claims, 7 Drawing Sheets

(51) Int. Cl.
*G03G 13/10* (2006.01)
*G03G 9/135* (2006.01)
*G03G 7/00* (2006.01)

(52) U.S. Cl.
CPC ..... *G03G 9/13* (2013.01); *G03G 9/131* (2013.01); *G03G 9/132* (2013.01); *G03G 9/1355* (2013.01); *G03G 13/10* (2013.01); *G03G 2215/00801* (2013.01)

(58) Field of Classification Search
CPC ..... G03G 9/1355; G03G 13/10; G03G 2215/00801
See application file for complete search history.

(56) References Cited

U.S. PATENT DOCUMENTS

| | | | | |
|---|---|---|---|---|
| 2010/0075113 | A1 | 3/2010 | Schumacher et al. | |
| 2010/0253063 | A1 | 10/2010 | Skogster | |
| 2011/0129606 | A1 | 6/2011 | Cooper | |
| 2011/0174180 | A1 | 7/2011 | Calderas et al. | |
| 2012/0058317 | A1 | 3/2012 | Seung et al. | |
| 2013/0224395 | A1 | 8/2013 | Regnier | |
| 2017/0329244 | A1* | 11/2017 | Tzomik ..... | G03G 7/002 |

FOREIGN PATENT DOCUMENTS

| | | |
|---|---|---|
| WO | WO-2014/206494 | 12/2014 |
| WO | WO-2015/114070 | 8/2015 |

* cited by examiner

PRIMING A PRINT SUBSTRATE

BACKGROUND

Electrophotographic printing processes, sometimes termed electrostatic printing processes, typically involve creating an image on a photoconductive surface, applying an ink having charged particles to the photoconductive surface, such that they selectively bind to the image, and then transferring the charged particles in the form of the image to a print substrate.

The photoconductive surface may be on a cylinder and is often termed a photo imaging plate (PIP). The photoconductive surface is selectively charged with a latent electrostatic image having image and background areas with different potentials. For example, an electrostatic ink composition including charged toner particles in a liquid carrier can be brought into contact with the selectively charged photoconductive surface. The charged toner particles adhere to the image areas of the latent image while the background areas remain clean. The image is then transferred to a print substrate (e.g. paper) directly or, by being first transferred to an intermediate transfer member, which can be a soft swelling blanket, which is often heated to fuse the solid image and evaporate the liquid carrier, and then to the print substrate.

A primer may be applied to a print substrate prior to printing to prepare the substrate for a subsequently applied liquid electrophotographic (LEP) ink.

BRIEF DESCRIPTION OF THE FIGURES

Features and advantages of examples of the present disclosure will become apparent by reference to the following detailed description and the drawings, in which like reference numerals correspond to similar, though perhaps not identical, components. For the sake of brevity, reference numerals or features having a previously described function may or may not be described in connection with other drawings in which they appear.

DETAILED DESCRIPTION

Figure 1:
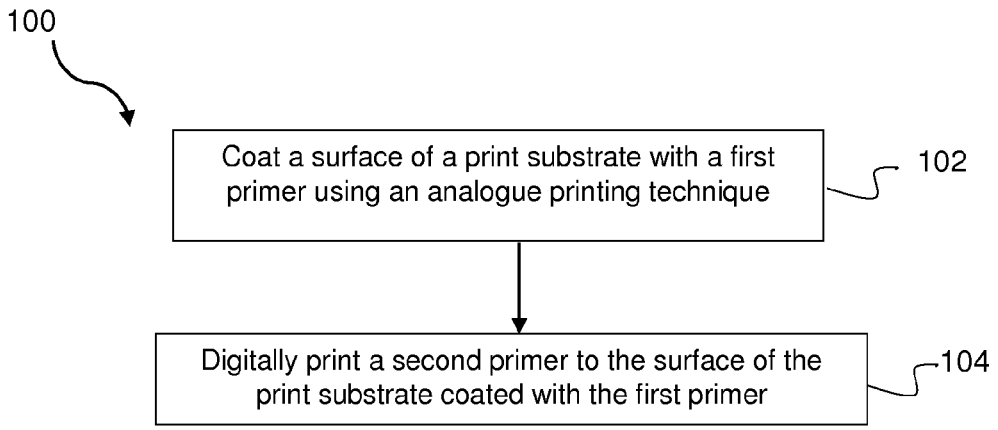
FIG. 1 is a flow diagram illustrating an example of a method for priming a print substrate.

Before the compositions, methods and related aspects of the disclosure are disclosed and described, it is to be understood that this disclosure is not restricted to the particular process features and materials disclosed herein because such process features and materials may vary somewhat. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "co-polymer" refers to a polymer that is polymerized from at least two monomers.

As used herein, "electrostatic(ally) printing" or "electrophotographic(ally) printing" generally refers to the process that provides an image that is transferred from a photo imaging substrate or plate either directly or indirectly via an intermediate transfer member to a print substrate, e.g. a paper substrate. As such, the image is not substantially absorbed into the photo imaging substrate or plate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrophotographic ink composition to an electric field, e.g. an electric field having a field strength of 1000 V/cm or more, in some examples 1000 V/mm or more.

As used herein, the term "about" is used to provide flexibility to a numerical range endpoint by providing that a given value may be a little above or a little below the endpoint. The degree of flexibility of this term can be dictated by the particular variable.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not just the numerical values explicitly recited as the end points of the range, but also to include all the individual numerical values or sub-ranges encompassed within that range as if each numerical value and sub-range is explicitly recited. As an illustration, a numerical range of "about 1 wt. % to about 5 wt. %" should be interpreted to include not just the explicitly recited values of about 1 wt. % to about 5 wt. %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

Unless otherwise stated, any feature described herein can be combined with any aspect or any other feature described herein.

In an aspect there is provided a method for priming a print substrate for subsequently receiving a liquid electrophotographic (LEP) ink. The method may comprise:

coating a surface of a print substrate with a first primer using an analogue printing technique; and digitally printing a second primer to the surface of the print substrate coated with the first primer.

In some examples, the method may comprise:

flood coating a surface of a print substrate with a first primer; and digitally printing a second primer to the surface of the print substrate coated with the first primer.

In another aspect there is provided a printing apparatus. The printing apparatus may comprise:

an analogue printing station for coating a surface of a print substrate with a first primer; and a liquid electrophotographic (LEP) printing station for liquid electrophotographically printing a second primer to the surface of the print substrate coated with the first primer, wherein the LEP printing station comprises:

a reservoir containing the second primer; and a photoconductive member having a surface on which a latent electrostatic image can be created, and wherein the printing apparatus is configured to print the second primer to the surface of the print substrate coated with the first primer such that the second primer is disposed on the first primer on the print substrate.

In some examples, the printing apparatus may comprise:

a flood coating station for flood coating a surface of a print substrate with a first primer; and a liquid electrophotographic (LEP) printing station for liquid electrophotographically printing a second primer to the surface of the print substrate coated with the first primer, wherein the LEP printing station comprises:

a reservoir containing the second primer; and a photoconductive member having a surface on which a latent electrostatic image can be created, and wherein the printing apparatus is configured to print the second primer to the surface of the print substrate coated with a first primer such that the second primer is disposed on the first primer on the print substrate.

In another aspect, there is provided a printing method. The printing method may comprise:

priming a print substrate to receive a LEP ink image; and liquid electrophotographically printing a pigmented liquid electrophotographic (LEP) ink image on to the primed print substrate, wherein priming comprises:

coating a surface of the print substrate with a first primer using an analogue printing technique; and digitally printing a second primer to the surface of the print substrate coated with the first primer to provide a primed print substrate, and wherein the pigmented LEP ink image is printed to be disposed on the second primer on the print substrate.

In some examples, the printing method comprises:

priming a print substrate to receive a LEP ink image; and liquid electrophotographically printing a pigmented liquid electrophotographic (LEP) ink image on to the primed print substrate, wherein priming comprises:

flood coating a surface of the print substrate with a first primer; and digitally printing a second primer to the surface of the print substrate coated with the first primer to provide a primed print substrate, and wherein the pigmented LEP ink image is printed to be disposed on the second primer on the print substrate.

Method for Priming a Print Substrate

Described herein is a method for priming a print substrate for subsequently receiving a liquid electrophotographic (LEP) ink, the method comprising:

coating a surface of a print substrate with a first primer using an analogue printing technique; and digitally printing a second primer to the surface of the print substrate coated with the first primer.

Also described herein is a print substrate comprising a first primer and a second primer disposed on a surface of the print substrate such that the second primer is disposed on the first primer which is disposed on the surface of the print substrate.

The present inventors have found that by priming a print substrate with a first primer which may be printed onto the print substrate using an analogue printing technique and then digitally printing a second primer to the surface of the print substrate coated with the first primer allows for improved transfer of ink to the print substrate in a printing process. For example, priming a print substrate as described herein allows for improved transfer of an ink, e.g. a LEP ink, from an intermediate transfer member to the print substrate.

Referring now to step 102 of FIG. 1, an example of the method 100 includes coating a surface of a print substrate with a first primer using an analogue printing technique.

The term 'analogue printing' is used herein to refer to methods of coating a print substrate, or coating systems for coating a print substrate, using a non-digital technique. For example, coating a surface of a print substrate with a first primer using an analogue printing technique may comprise flood coating a surface of the print substrate with a first primer, for example coating part, or all, of a surface of the substrate in a non-selective manner. In some examples, coating a surface of a print substrate using an analogue printing technique may comprise selectively applying the first primer to the print substrate. Analogue printing techniques may be selected from, for example, rod-coating, gravure coating, roll coating, flexographic printing, lithography, spray coating, screen printing and the like.

First Primer

A first primer as described herein may also be referred to as an analogue primer and is a primer which is capable of being coated onto a substrate using an analogue printing technique.

In some examples the first primer is colourless. For example, the first primer may not contain any pigment, or comprises substantially lacks pigment and thus may be a pigment-free composition. The first primer may otherwise be termed a colourless first primer or a colourless primer for analogue printing. The first primer may be substantially free of colorant, for example the first primer may comprise less than 1 wt % solids of colorant, in some examples less than 0.1 wt % solids of colorant, in some examples less than 0.01 wt % solids of colorant. "Colorant" may be a material that imparts a color to the first primer. As used herein, "colorant" includes pigments and dyes, such as those that impart colors such as black, magenta, cyan and yellow to an ink. As used herein "pigment" generally includes pigment colorants such as those that impart colors such as black, magenta, cyan and yellow to an ink.

In some examples, the first primer comprises a first primer resin dispersed in a carrier solvent. In some examples the first primer carrier solvent is a polar carrier liquid. In some examples, the first primer is an aqueous primer (i.e. the carrier solvent/polar carrier liquid is water). In some examples, the polar carrier may be a polar solvent, for example alcohol such as ethanol.

In some examples, the first primer comprises a first primer resin. In some examples the first primer resin may be a polymer which is dispersible or dissolvable in the carrier solvent. In some examples, the carrier solvent is a polar carrier liquid. In some examples, the first primer resin may be selected from the group comprising or consisting of hydroxyl containing resins (e.g., polyvinyl alcohol resins and cellulose derivatives) carboxylic group containing resins (e.g., olefin co-acrylic or methacrylic acid based copolymers, polyacrylic acid based polymers and polylactic acid based polymers) amine based polymer formulations (e.g., polyamines, polyamides and polyethylene imines), polyurethanes, polyesters and combinations thereof. In some examples, the first primer resin may be selected from the group comprising, or consisting of, a polyvinyl alcohol resin, cellulose based resins, a polyester, a polyamine, a polyethylene imine resin, polyamide resin, polyurethane, copolymers of an alkylene monomer and an acrylic or methacrylic acid monomer, polyacrylic polymers and combinations thereof. In some examples, the first primer comprises polyamides, copolymers of ethylene and acrylic acid, polyethylene imines, or combinations thereof.

In some examples, the primer resin comprises a carboxylic functional group, an amine functional group or a polyol functional group. In some examples, the primer resin comprises an amine functional group or a carboxylic functional group.

Examples of materials suitable as the first primer are DigiPrime® 050, DigiPrime® 060, DigiPrime® 1500LA, DigiPrime® 2000, DigiPrime® 2500, DigiPrime® 3000, DigiPrime® 4431, DigiPrime® 4450, DigiPrime® 5000, DigiPrime® 5100, DigiPrime® 680, Michem® In-Line Primer 030, Michem® In-Line Primer 040, Michem® In-Line Primer Q4304A, Michem® In-Line Primer Q4305A, Michem® In-Line Primer Q4324A, Michem® In-Line Primer Q4325A, Sapphire 5.0 and Topaz 17 Solution (all available from Michelman®).

Print Substrate

The print substrate may be any suitable substrate. The print substrate may be any suitable substrate capable of having an image printed thereon. The print substrate may include a material selected from an organic or inorganic material. The material may include a natural polymeric material, e.g. cellulose. The material may include a synthetic polymeric material, e.g. a polymer formed from alkylene monomers, including, for example, polyethylene and polypropylene, and co-polymers such as styrene-polybutadiene. The polypropylene may, in some examples, be biaxial orientated polypropylene. In an example, the substrate includes a cellulosic paper. In an example, the cellulosic paper is coated with a polymeric material, e.g. a polymer formed from styrene-butadiene resin. In some examples, the cellulosic paper has an inorganic material bound to its surface (before printing with ink) with a polymeric material, wherein the inorganic material may be selected from, for example, kaolinite or calcium carbonate. The substrate is, in some examples, a cellulosic print substrate such as paper. The cellulosic print substrate is, in some examples, a coated cellulosic print. In some examples, the print substrate is a transparent print substrate, for example the print substrate may be formed from a transparent material such as a transparent polymeric material, e.g. a polymer formed from alkylene monomers, including, for example, polyethylene and polypropylene, and co-polymers such as styrene-polybutadiene.

In some examples the print substrate has a thickness greater than 50 μm, in some examples greater than 100 μm, in some examples greater than 200 μm, in some examples greater than 300 μm, in some examples greater than 400 μm, in some examples greater than 450 μm. In some examples the print substrate has a thickness of up to about 1000 μm, in some examples up to about 2000 μm.

In some examples, the print substrate is cardboard.

The present inventors have found that the method described herein may provide particular advantages for some substrates on which printing of LEP inks can be difficult, for example cardboard.

In some examples, coating the surface of a print substrate with a first primer using an analogue printing technique comprises applying at least about 0.5 $g/m^2$ of first primer onto the surface of the print substrate, in some examples at least about 1 $g/m^2$. In some examples, coating the surface of a print substrate with a first primer using an analogue printing technique comprises applying up to about 5 $g/m^2$ of first primer onto the surface of the print substrate, in some examples up to about 3 $g/m^2$, in some examples up to about 2 $g/m^2$, in some examples up to about 1.5 $g/m^2$, in some examples up to about 1.4 $g/m^2$.

In some examples, the method comprises drying the print substrate coated with a first primer. In some examples, the print substrate coated with the first primer is dried before the second primer is digitally printed on to the surface of the print substrate coated with the first primer. In some examples, the print substrate coated with the first primer is dried at a temperature of 60-80° C. In some examples, the print substrate coated with the first primer is dried to evaporate the carrier solvent, e.g. polar carrier from the first primer. Drying the first primer on the first substrate before printing a second primer onto the first primer has been found to improve the life of the surface of an intermediate transfer member which may be used to transfer a second primer to a print substrate in a digital printing process.

The first primer, when coated onto a print substrate and dried, may be substantially free from carrier solvent, e.g. polar carrier. Substantially free from carrier solvent may indicate that the second primer printed on the print substrate contains less than 5 wt % carrier solvent, in some examples, less than 2 wt % carrier solvent, in some examples less than 1 wt % carrier solvent, in some examples less than 0.5 wt % carrier solvent. In some examples, the first primer coated and dried on the print substrate is free from liquid carrier. The first primer, when coated onto and dried on the print substrate may be present with a coat weight of about 0.01 $g/m^2$ to about 0.5 $g/m^2$. The coat weight of the first primer applied to the print substrate may be controlled by the solid content of the first primer. In examples in which the analogue printing technique used to coat the print substrate with a first primer is a gravure coating technique, the coat weight of the first primer on the print substrate may be controlled by the gravure cell depth and shape and the softness of rubber used on the gravure rollers.

Referring now to step 104 of FIG. 1, an example of the method 100 includes digitally printing a second primer to the surface of the print substrate coated with the first primer. In this way a print substrate having a surface on which the first primer is disposed and a second primer disposed on the first primer is provided.

Second Primer

A second primer as described herein may also be referred to as a digital primer and is a primer which is capable of being digitally printed onto a substrate. In some examples, the second primer or digital primer is a primer that is capable of being liquid electrostatically printed onto a substrate.

In some examples the second primer is colourless. For example, the second primer may not contain any pigment, or comprises substantially lacks pigment and thus may be a pigment-free composition. The second primer may otherwise be termed a colourless second primer or a colourless primer for digital printing. In some examples the second primer may be substantially free of a pigment or colorant, for example the second primer may comprise less than 1 wt % solids of colorant, in some examples less than 0.1 wt % solids of colorant, in some examples less than 0.01 wt % solids of colorant. "Colorant" may be a material that imparts a color to the second primer.

In some examples, the second primer may comprises a second primer resin and a solid polar compound. In some examples, the second primer may comprises a second primer resin, a non-polar carrier liquid and a solid polar compound. In some examples, the second primer comprises a second primer resin, a solid polar compound and a charge adjuvant. In some examples, the second primer comprises a second primer resin, a solid polar compound, a charge adjuvant and a non-polar carrier liquid.

In some examples the solid polar compound of the second primer is dispersed in the second primer resin, for example dispersed in the second primer resin swollen with a non-polar carrier liquid. In some examples, the solid polar compound is a compound selected from the group consisting of a cellulose microcrystalline powder, dextrin, maltose monohydrate, polyacrylic acid, polyvinyl alcohol, a styrene maleic anhydride copolymer, a bismaleimide oligomer, sucrose, sucrose octaacetate, sucrose benzoate, and combinations thereof. In some examples, the styrene maleic anhydride copolymer is selected from i) styrene maleic anhydride resin, cumene end-capped and ii) a copolymer of styrene and dimethyl amino propylamine maleimide. Examples of commercially available styrene maleic anhydride copolymers include those from Sartomer Co. USA, LLC, such as SMA® 40001 and SMA® 10001 (i.e., styrene and dimethyl amino propylamine (DMAPA) maleimides) and SMA® 1000P (styrene maleic anhydride resin, cumene end-capped). A suitable example of a bismaleimide oligomer is bis-stearamide. In some examples, the solid polar compound is selected from maltose monohydrate and polyacrylic acid. All of these solid polar compounds contains polar atoms, such as oxygen, nitrogen, etc., that, for example, prevent the solid compounds from dissolving or even swelling in a non-polar carrier fluid.

In some examples, the solid polar compound may constitute up to about 60 wt. % of the solids in the second primer. In some examples, the solid polar compound may constitute at least about 10 wt. % of the solids in the second primer. In some examples, the solid polar compound constitute from about 10 wt. % to about 60 wt. % of the solids in the second primer, in some examples 30 to 50 wt. % of the solids in the second primer.

The second primer resin may be thermoplastic resin. In some examples, the second primer resin may be any solid polymer that is able to swell in the non-polar carrier liquid of the second primer (i.e. a solid polymer that is capable of increasing in size as a result of accumulation of the non-polar carrier liquid). The second primer resin may be selected to be able to emit the non-polar carrier liquid with the resin is exposed to heat during printing, e.g. a temperature of about 50° C. to about 120° C., in some examples 80 to 110° C. The second primer resin may comprise a polymer having acidic side groups. Examples of suitable second primer resins include copolymers of alkylene monomers and acrylic or methacrylic acid monomers, e.g. ethylene acrylic acid copolymers and/or ethylene methacrylic acid copolymers. In some examples, the second primer resin may comprise a copolymer of ethylene acrylic acid and a copolymer of ethylene methacrylic acid. Ethylene acrylic acid copolymers and ethylene methacrylic acid copolymers are available commercially under the tradename Nucrel® (from E.I DuPont).

In some examples, the second primer resin may constitute at least 30 wt. % of the solids in the second primer, in some examples at least 40 wt. %. In some examples, the second primer resin may constitute 10% to 90% by weight of the solids in the second primer, in some examples 20 to 85 wt. %, in some examples 30 to 80 wt. % of the solids of the second primer. The remaining wt % of the solids in the second primer may be a solid polar compound, in some examples solid polar compounds and charge adjuvants and, in some examples, any other additives that may be present.

The non-polar carrier liquid may be an electrical insulator having a resistivity in excess of about $10^9$ ohm·cm. The non-polar liquid carrier may have a dielectric constant below about 5, in some examples below about 3. The non-polar liquid carrier can include hydrocarbons. The hydrocarbon can include, for example, an aliphatic hydrocarbon, an isomerized aliphatic hydrocarbon, branched chain aliphatic hydrocarbons, aromatic hydrocarbons, and combinations thereof. Examples of the liquid carriers include, for example, aliphatic hydrocarbons, isoparaffinic compounds, paraffinic compounds, dearomatized hydrocarbon compounds, and the like. In particular, the liquid carriers can include, for example, Isopar-G™, Isopar-H™, Isopar-L™, Isopar-M™, Isopar-K™, Isopar-V™, Norpar 12™, Norpar 13™, Norpar 15™, Exxol D40™, Exxol D80™, Exxol D100™, Exxol D130™, and Exxol D140™ (each sold by EXXON CORPORATION); Teclen N-16™, Teclen N-20™, Teclen N-22™ Nisseki Naphthesol L™, Nisseki Naphthesol M™, Nisseki Naphthesol H™, #0 Solvent L™, #0 Solvent M™, #0 Solvent H™, Nisseki Isosol 300™, Nisseki Isosol 400™, AF-4™, AF-5™, AF-6™ and AF-7™ (each sold by NIPPON OIL CORPORATION); IP Solvent 1620™ and IP Solvent 2028™ (each sold by IDEMITSU PETROCHEMICAL CO., LTD.); Amsco OMS™ and Amsco 460™ (each sold by AMERICAN MINERAL SPIRITS CORP.); and Electron, Positron, New II, Purogen HF (100% synthetic terpenes) (sold by ECOLINK™).

In some examples the second primer includes a charge adjuvant. The charge adjuvant may promote charging of the particles of the second resin when a charge director is present. In some examples the charge adjuvant provides a molecular structure to trap charge director molecules around the second primer resin(s).

In some examples, the charge adjuvant may include, for example, metallic soaps containing a metal, such as Al, Zn, Ca, Mg, Y, other metals, and combinations thereof, and a ligand, such as stearate, oleate, palmitate, other ligands, or combinations thereof. Examples of metallic soaps include aluminum tristearate, aluminum distearate, polyoxo aluminum stearate (POAS), polyoxo aluminum palmitate, oxo-aluminum acrylates, Y(III) stearate, or any other metallic salt whose leaving group is capable of dissolving in the non-polar carrier fluid.

In some examples, the charge adjuvant may have the formula $X_n(R^a)(R^b)$ or $X_n(R^a)(R^b)(COOH)$ where X is F, Cl, Br, $NO_2$ or CN; $R^a$ is a substituted or unsubstituted alkyl group; $R^b$ is Sb, P, Ti, Sn, B, Al, Zn, or an aromatic group; and n is 1, 2, 3, 4 or 5. In an example, the charge adjuvant has the formula $Cl_n(R^a)(R^b)(COOH)$, where $R^a$ is a substituted or unsubstituted alkyl group having 3, 4 or 5 carbon atoms, $R^b$ is a benzene or a phenol group, and n is 1 or 2. Another example of the charge adjuvant is a chlorobenzene based compound, such as $Cl(R^a)(R^b)(COOH)$, where $R^a$ is an alkyl group having 5 carbon atoms and $R^b$ is a benzene group. Still another example of the acceptor charge adjuvant has $Cl_2(R^a)(R^b)(COOH)$, where $R^a$ is an alkyl group having 4 carbon atoms and $R^b$ is a phenol group. Still other examples this charge adjuvant include chloro-phenyl carboxylic acid, 2-(4-chlorophenyl)-3-methylbutyric acid, and 4-(2,4-dichlorophenoxy)butyric acid.

The term "alkyl" as used in the examples of the charge adjuvant means a branched, unbranched or cyclic saturated hydrocarbon group, which may contain from 1 to 20 carbon atoms. Alkyls include, for example, methyl, ethyl, npropyl, isopropyl, n-butyl, isobutyl, t-butyl, octyl, and decyl, as well as cycloalkyl groups, such as cyclopentyl, and cyclohexyl. The alkyl may be a lower alkyl group, which includes from 1 to 8 carbon atoms. In some examples, $R^a$ is a substituted alkyl group or a heteroalkyl alkyl group. As used herein, the term "substituted alkyl" means an alkyl substituted with one or more substituent groups; and the term "heteroalkyl" means an alkyl in which at least one carbon atom is replaced with a heteroatom.

The charge adjuvant may be present in an amount of about 0.05% by weight to about 8 wt. % of the total solids of the second primer, in some examples 0.1 to 5 wt. % t, in some examples about 0.1 to 1 wt. %, in some examples about 0.3 to 0.8 wt. %, in some examples about 1 wt % to 3 wt % of the solids, in some examples about 1.5 wt % to 2.5 wt % of the solids of the second primer.

The second primer may include a charge director. The charge director may be a negative charge director or a positive charge director.

Examples of negative charge directors include organic multi-valent metal surfactant salts. These organic salts are soluble in the non-polar carrier fluid, for example, at room temperature. In one example, the organic multi-valent metal salt includes polyvalent metal ions, and organic anions as the counterion. Examples of suitable metal ions include Ba(II), Ca(II), Mn(II), Zn(II), Zr(IV), Cu(II), AI(III), Cr(III), Fe(II), Fe(III), Sb(III), Bi(III), Co(II), La(III), Pb(II), Mg(II), Mo(III), Ni(II), Ag(I), Sr(II), Sn(IV), V(V), Y(III), Ta(V), and Ti(IV). Examples of suitable organic anions include carboxylates or sulfonates derived from aliphatic or aromatic carboxylic or sulfonic acids. Other negative charge directors include polyisobutylene succinimide polyamines (an example of which includes OLOA®1200, available from Chevron Oronite). Still other examples of the negative charge director include metal salts of fatty acids (e.g., calcium palmitate); metal salts of sulfo-succinates; metal salts of oxyphosphates; metal salts of alkyl-benzenesulfonic acid; metal salts of aromatic carboxylic acids or sulfonic acids; metal salts of naphthenic acid (e.g., barium petronate); polyoxyethylated alkylamines; lecithin; polyvinyl-pyrrolidone; and/or organic acid esters of polyvalent alcohols. While several examples are provided, it is to be understood that other negative charge directors may also be utilized in the examples disclosed herein.

Examples of positive charge directors include the organic multi-valent metal surfactant salts and the polyisobutylene succinimide polyamines previously discussed. As specific examples, the positive charge director may be a transition metal salt of a fatty acid, such as aluminum stearate, or a transition metal salt of naphthenic acid, such as cobalt naphthanate. Still other specific examples of positive charge directors include manganese naphthenate, manganese octoate, zirconium octoate, cobalt octoate, iron naphthenate, magnesium octoate, titanium(IV)2-ethyl-1,3 hexanediolate, titanium(IV)-2-ethylhexyloxide, zirconium(IV)-ter-butoxide, tantalum(V)-butoxide, polyoxo-aluminum tristearate, zinc naphthenate, barium distearate and calcium stearate. In one example, the positive charge director is zirconium(IV) octoate or 2-ethyl hexanoate. In another example, the positive charge director is zirconium(IV) 2-ethyl hexanoate (i.e., ZZ11). While several examples are provided, it is to be understood that other positive charge directors may also be utilized in the examples disclosed.

In some examples, the charge director constitutes about 0.01% to 20% by weight, in some examples 1 to 15% by weight, in some examples 1% to 10% by weight of the solids of the second primer. In an example, the amount of charge director added to second primer, e.g. the diluted second primer ranges from about 10 mg per g of total solids to about 150 mg per g of total solids (from about 1 wt. % to about 15 wt. % of the total solids present in the diluted colorless primer).

In some examples, the second primer comprises:

a second primer resin;

up to about 60 wt. % by total solids of a solid polar compound; and a non-polar carrier liquid.

The second primer may include a colourless paste comprising a non-polar carrier liquid and a second primer resin swollen in the non-polar carrier liquid. The second primer resin may be present in the paste in an amount ranging from about 20% (w/w) to about 50% (w/w). The second primer may include a colourless paste and a solid polar compound dispersed in the resin of the colourless paste. The paste may include other additives, such as derivatives of polytetrafluoroethylene (PTFE) and polyethylene wax. These additives do not swell in the non-polar carrier fluid. These additives may be included in the paste in an amount ranging from about 1 wt. % to about 20 wt. % of the total wt. %.

In some examples, the second primer comprises:

a paste (e.g. a colourless paste) comprising:

a non-polar carrier liquid; and a second primer resin swollen in the non-polar carrier fluid, the second primer resin present in the paste in an amount ranging from about 20% (w/w) to about 50% (w/w); and a solid polar compound dispersed in the resin, the solid polar compound being selected from the group consisting of a cellulose microcrystalline powder, dextrin, maltose monohydrate, polyacrylic acid, polyvinyl alcohol, a styrene maleic anhydride copolymer, a bismaleimide oligomer, sucrose, sucrose octaacetate, sucrose benzoate, and combinations thereof, and the solid polar compound being present in an amount up to 60 wt. % of solids in the paste. In some examples, the second primer may comprise additional non-polar carrier liquid so that a total solids content of the second primer ranges from about 1% (w/w) to about 5% (w/w).

The non-polar liquid carrier can constitute about 20% to 99.5% by weight of the second primer, in some examples 50 wt. % to 99.5 wt. %, in some examples about 40 to 90 wt. %, in some examples about 60 to 80 wt. %, in some examples, about 90 to 99.5 wt. %, in some examples 95 to 99 wt. % of the second primer.

The second primer, when printed on a print substrate, may be substantially free from liquid carrier. In an electrostatic printing process and/or afterwards, the liquid carrier may be removed, e.g. by an electrophoresis processes during printing and/or evaporation, such that substantially just solids are transferred to the print substrate. Substantially free from liquid carrier may indicate that the second primer printed on the print substrate contains less than 5 wt % liquid carrier, in some examples, less than 2 wt % liquid carrier, in some examples less than 1 wt % liquid carrier, in some examples less than 0.5 wt % liquid carrier. In some examples, the second primer printed on the print substrate is free from liquid carrier.

The second primer may be obtained by providing a paste (e.g. a colourless paste) comprising a second primer resin and a non-polar carrier liquid and adding a solid polar compound to the paste. In some examples, the solid polar compound any be added in any amount up to 60 wt. % of total solids in the paste. For example, about 10 to 60 wt. % solid polar compound by total solids in the paste may be added. The paste may be ground with the solid polar compound, for example by milling (e.g. using a mixing apparatus such as an attritor) the mixture of the paste and the solid polar compounds.

Grinding/milling is accomplished using suitable conditions (e.g., speed, temperature, etc.) for a suitable time to disperse the solid polar compounds in the second primer resin of the paste. In an example, the speed may be about 250 rpm and the temperature may range from about 25° C. to about 40° C. In one example, grinding may be accomplished for about 12 hours to about 48 hours. This process causes the solid polar compounds to disperse throughout the second primer resin, thereby occupying area(s) within the second primer resin that may otherwise become swollen with the non-polar carrier fluid. In some instances, this process also causes the solid polar compounds to de-agglomerate into discrete particles. For instance, during milling, the solid polar compound agglomerates may break up into discrete particles, which have an average particle size ranging from about 30 nm to about 300 nm.

During the grinding/milling process, the particle size may be monitored, e.g., via dynamic light scattering (DLS). After the grinding/milling process, the particle size may be determined using a Malvern particle size analyzer.

A charge adjuvant may be added to the mixture during the grinding process. This causes the charge adjuvant to become part of the swollen resin(s), by virtue of chemical bonding or physical association.

During grinding, it is to be understood that grinding aids may also be added.

The paste (which is in a concentrated form having a solids content ranging from 20% (w/w) to less than 100% (w/w)) formed grinding may be diluted so that the solids content ranges from 1% (w/w) to 5% (w/w). In an example, the ground mixture is supplied to a machine (e.g., an ink tank of an LEP printer) in the concentrated form. Additional non-polar carrier liquid may be added to dilute the mixture to the desired solids content.

Digitally Printing the Second Primer

The term 'digital printing' (or 'digitally printing') is used herein to refer to methods of printing from a digital-based image onto a print substrate. Liquid electrophotographic (LEP) printing is an example of a digital printing technique. Digital printing techniques allow images to be printed to a substrate in a selective manner.

Digitally printing the second primer to the print substrate allows the second primer to be applied to the print substrate in a selective manner. In some examples, digitally printing the second primer to the print substrate comprises selectively applying the second primer to the print substrate, for example applying the second primer to areas (e.g. only these areas) of the print substrate to which a LEP ink image may subsequently be printed.

In some examples, the method comprises liquid electrophotographically printing the second primer to the surface of the print substrate coated with the first primer. Liquid electrophotographically printing the second primer to the surface of the print substrate coated with the first primer may comprise:

forming a latent image on a photoconductive member;

contacting the second primer with the latent image on the photoconductive member to form a second primer image on the photoconductive member; and transferring the second primer image to the print substrate.

In some examples, transfer of the second primer image from the photoconductive member to the print substrate may be via an intermediate transfer member (ITM). In some examples, the ITM is heatable. In some examples, the ITM is heatable and may be used to evaporate carrier liquid from the second primer, e.g. to form a second primer image film, on the ITM before transfer of the second primer image from the ITM to the print substrate.

In some examples, liquid electrophotographically printing a second primer image on a print substrate comprises removing, e.g. evaporating, carrier liquid from the second primer image before transferring the second primer image to the print substrate. In some examples evaporation of carrier liquid from the second primer image may take place on the ITM. In some examples, the process comprises heating the second primer image, e.g. on an ITM, at a temperature in the range of 80 to 120° C., for example to evaporate a carrier liquid from the second primer image and form a second primer image film to be transferred to the print substrate.

The second primer may be digitally printed onto a print substrate in a liquid electrophotographic process. Examples of suitable liquid electrophotographic printing equipment are the HP Indigo digital presses, e.g. the HP Indigo 2000, 3000, 4000, 5000, 6000, 7000, 10000, 20000 and 30000 series presses.

Figure 2:
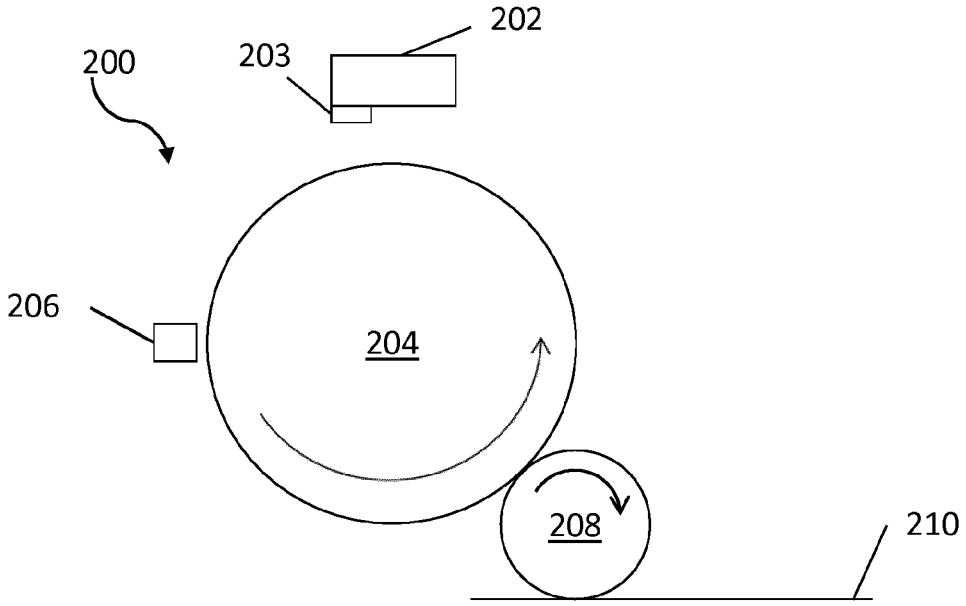
FIG. 2 is a schematic diagram of an example of a liquid electrophotographic printer.

A schematic illustration of an LEP digital printing press is shown in FIG. 2. As illustrated, the LEP digital printing press 200 may include a photo-imaging cylinder 204 (including the previously mentioned photoconductive member, e.g. the surface of the photo-imaging cylinder 204), a photo charging unit 202, a laser imaging portion 203, a Binary Ink Developer (BID) unit 206 and an intermediate transfer member (ITM) 208 to transfer a second primer image formed on the photo-imaging cylinder 204 to a print substrate 210. The second primer may be stored in a reservoir within or in fluid communication with the BID unit 206.

According to an illustrative example, in order to print the second primer, firstly, the photo charging unit 202 deposits a uniform static charge on the photo-imaging cylinder 204. The latent electrostatic image is an electrostatic charge pattern representing the image to be printed. In an example, it may be desirable to apply the second primer to the entire surface of the print substrate 210. In an example, it may be desirable to apply the second primer on only those portions of the print substrate 210 that will ultimately have LEP ink applied thereon, and thus the latent image may be the desirable shape for the final printed image. The laser imaging portion 203 of the photo charging unit 202 is used to discharges the static charges in selected portions of the photo-imaging cylinder 204 to create a latent electrostatic image on the photo-imaging cylinder 204.

The second primer is then transferred to the photo-imaging cylinder 204 by Binary Ink Developer (BID) unit 206. The second primer accumulates on a developer roller of the BID unit 6 and forms a charged second primer layer which is supplied to the photo-imaging cylinder 204 where the charged second primer accumulates on the imaged areas (i.e. the latent image) only of the photo-imaging cylinder 204. The charged second primer which, by virtue of an appropriate potential on the electrostatic image areas, is attracted to the latent electrostatic image on the photo-imaging cylinder 204 (first transfer). The second primer does not adhere to the uncharged, non-image areas and forms an image on the surface of the latent electrostatic image. The photo-imaging cylinder 204 then has a developed second primer image on its surface.

The second primer image is then transferred from the photo-imaging cylinder 204 to the intermediate transfer member (ITM) 208 by virtue of an appropriate potential applied between the photo-imaging cylinder 204 and the ITM 208, such that the charged second primer is attracted to the ITM 208 (second transfer). The second primer image is then formed into a second primer film on the ITM 208 before being transferred to a print substrate 210.

In some examples, the second primer may be printed onto the print substrate to provide a coat weight of second primer solids of from about 0.5 to 1.5 $g/m^2$, in some examples from about 0.5 to 1 $g/m^2$. The coat weight of the second primer on the print substrate may be controlled by the degree of charging of the second primer, and/or by the potential applied to a developer roller of the BID unit from which the second primer is provided to a latent image on a photoconductive member.

In some examples, the first primer is applied to a surface of the print substrate using a coating system or an analogue printing system which is off-line with respect to the liquid electrophotographic printing apparatus subsequently used to digitally print the second primer to the surface of the print substrate coated with the first primer. In some examples, a print substrate may be coated with a first primer and then stored until required. When required, a second primer may be digitally printed onto the print substrate coated with the first primer.

In some examples, the first primer is applied to a surface of the print substrate using a coating system or an analogue printing system in-line with the liquid electrophotographic printing apparatus subsequently used to digitally print the second primer to the surface of the print substrate coated with the first primer. For example, the analogue printing system may be a gravure coating system which is in line with a liquid electrophotographic printing press, for example as shown in the printing apparatus schematically illustrated in FIG. 3.

Printing Apparatus

Described herein is a printing apparatus. The printing apparatus may comprise:

an analogue printing station for coating a surface of a print substrate with a first primer; and a liquid electrophotographic (LEP) printing station for liquid electrophotographically printing a second primer to the surface of the print substrate coated with the first primer, wherein the LEP printing station comprises:

a reservoir containing the second primer; and a photoconductive member having a surface on which a latent electrostatic image can be created, and wherein the printing apparatus is configured to print the second primer to the surface of the print substrate coated with the first primer such that the second primer is disposed on the first primer on the print substrate.

Figure 3:
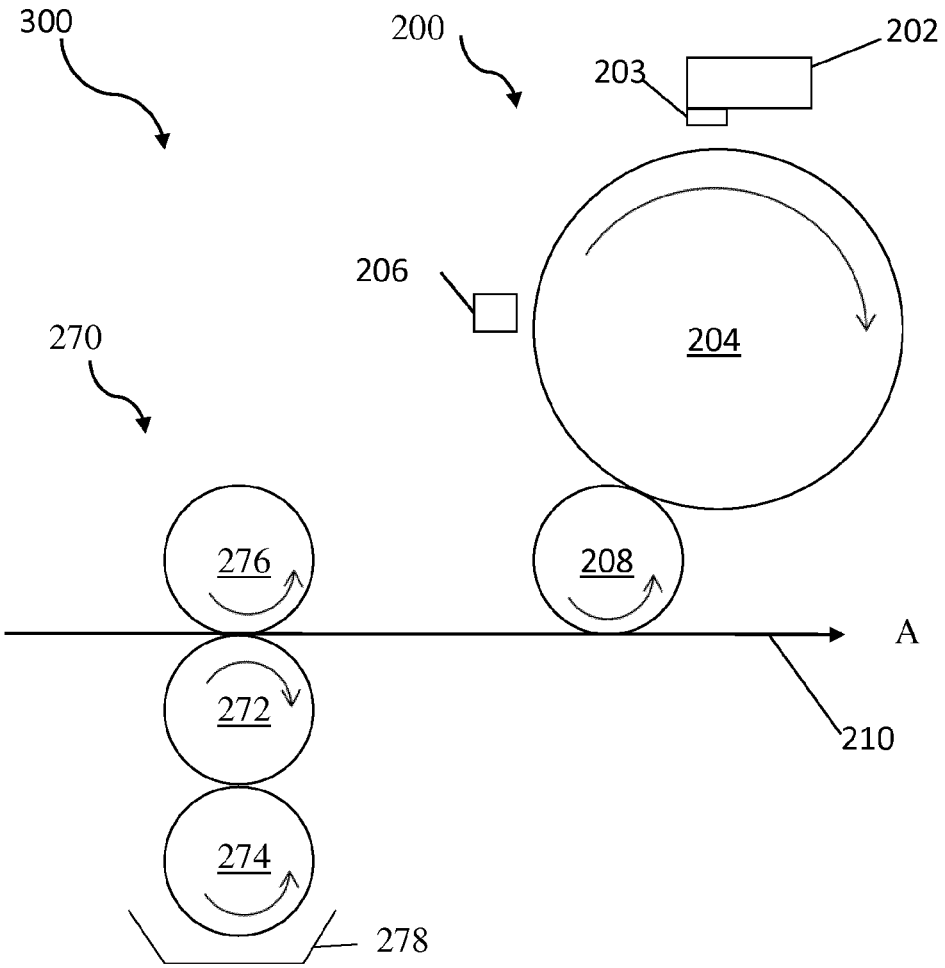
FIG. 3 is a schematic diagram of an example of a printing apparatus.

An example of a printing apparatus 300 is schematically illustrated in FIG. 3. The printing apparatus may comprises an analogue printing station 270 and a liquid electrophotographic (LEP) printing station 200. The liquid electrophotographic (LEP) printing station 200 may be as described above in relation to FIG. 2. The liquid electrophotographic (LEP) printing station 200 may also be operated as described above. The LEP printing station 200 may comprise a plurality of BID units 206. One of the BID units 206 of the LEP printing station may comprise a reservoir containing a second primer. Additional BID units 206 of the LEP printing station may comprise a reservoir containing a LEP ink.

In an example, the printing apparatus 300 may comprise an analogue printing station 270 which is a gravure printing system, for example an offset gravure printing system comprising a gravure roller 274, which may comprise gravure cells on the surface thereof for receiving a first primer, a first primer transfer roller 272 for transferring a first primer from the gravure roller 274 to the print substrate 210 which may be passed through the printing apparatus 300 in the direction shown by arrow A. The offset gravure printing system of the analogue printing station 270 shown in FIG. 3 may also comprise an impression roller 276 for contacting the print substrate 210 with the first primer transfer roller 272 to aid transfer of first primer from the first primer transfer roller 272 to a surface of the print substrate 210. In the example shown in FIG. 3 the offset gravure printing system of the analogue printing station 270 comprises a tray 278 for holding first primer from which the gravure roller 274 collects first primer for transfer to the first primer transfer roller 272.

In other examples, the analogue printing station 270 may comprise a direct gravure coating system, a roll coating system, a flexographic printing system, a lithographic printing system, a spray coating system, a screen printing system, or the like for applying the first primer to a surface of the print substrate.

The printing apparatus may also comprise a drying station for drying the first primer coated on the print substrate. The drying station may be positioned between the analogue printing station 270 and the liquid electrophotographic printing station 200 for drying the first primer coated on the print substrate before printing of the second primer onto the surface of the print substrate coated with the first primer.

The printing apparatus 300 may also comprise a drive member for transferring the print substrate 210 from the analogue printing station to the LEP printing station 200. In an example, the drive member transfers the print substrate from the print substrate 210 from the analogue printing station to the LEP printing station 200 via a drying station to dry the first primer coated on a surface of the print substrate. In some examples, the printing apparatus 300 also comprises a controller in communication with the drive member, for example to control the position of the print substrate 210 within the printing apparatus 300.

Printing Method

Described herein is a printing method comprising:

priming a print substrate to receive a LEP ink image; and liquid electrophotographically printing a pigmented liquid electrophotographic (LEP) ink image on to the primed print substrate, wherein priming comprises:

coating a surface of the print substrate with a first primer using an analogue printing technique; and digitally printing a second primer to the surface of the print substrate coated with the first primer to provide a primed print substrate, and wherein the pigmented LEP ink image is printed to be disposed on the second primer on the print substrate.

The priming of the print substrate may comprise coating a surface of the print substrate with a first primer using an analogue printing technique as described above. The priming of the print substrate may comprise digitally printing a second primer onto the surface of the print substrate coated with the first primer as described above.

The method of printing may comprise liquid electrophotographically printing a pigmented LEP ink to form a LEP ink image disposed on the second primer on the surface of a print substrate coated with the first primer.

Liquid electrophotographically printing a LEP ink to form a LEP ink image disposed on the second primer on the surface of a print substrate coated with the first primer may comprise:

forming a latent image on a photoconductive member;

contacting the LEP ink with the latent image on the photoconductive member to form a LEP ink image on the photoconductive member; and transferring the LEP ink image to the print substrate such that the LEP ink image is disposed on the second primer on the surface of a print substrate coated with the first primer.

In some examples, transfer of the LEP ink image from the photoconductive member to the print substrate may be via an intermediate transfer member (ITM). In some examples, the ITM is heatable. In some examples, the ITM is heatable and may be used to evaporate carrier liquid from the LEP ink, e.g. to form a LEP ink image film, on the ITM before transfer of the LEP ink image from the ITM to the print substrate.

In some examples, liquid electrophotographically printing a LEP ink image on a print substrate comprises removing, e.g. evaporating, carrier liquid from the LEP ink image before transferring the LEP ink image to the print substrate. In some examples evaporation of carrier liquid from the LEP ink image may take place on the ITM. In some examples, the process comprises heating the second primer image, e.g. on an ITM, at a temperature in the range of 80 to 120° C., for example to evaporate a carrier liquid from the LEP ink image and form a second primer image film to be transferred to the print substrate.

The LEP ink may be digitally printed onto a print substrate in a liquid electrophotographic process. Examples of suitable liquid electrophotographic printing equipment are the HP Indigo digital presses, e.g the HP Indigo 2000, 3000, 4000, 5000, 6000, 7000, 10000, 20000 and 30000 series presses.

The LEP ink may be printed onto a print substrate in the same way as described above for the second primer in connection with FIG. 2.

In some examples, the second primer and a/multiple LEP ink(s) may be printed on the print substrate in a one-shot process, e.g. a process in which an image comprising a second primer and a LEP ink is printed onto a surface of the print substrate coated with the first primer in one pass of the print substrate through the LEP printing station 270. In a one-shot process, a latent electrostatic image is formed on the photo-imaging cylinder 204 and a LEP ink is transferred from a BID unit 206 to the photo-imaging cylinder 204 by electrical forces to form a LEP ink image on the photo-imaging cylinder 204. In this one pass method, the LEP ink image is then transferred from the photo-imaging cylinder 204 to the ITM 208. Subsequent coloured LEP ink images may then be formed on top of the first LEP ink image disposed on the ITM 208. Another latent electrostatic image is then formed on the surface of the photo-imaging cylinder 204 and the second primer is transferred from a BID unit 206 to the photo-imaging cylinder 204 by electrical forces to form a second primer image on the photo-imaging cylinder 204. In this one pass method, the second primer image is then transferred from the photo-imaging cylinder 204 to the ITM 208 such that the second primer image is disposed on the coloured LEP ink images on the ITM 208. The second primer image is then transferred to the print substrate 210 along with the coloured LEP ink images such that the coloured LEP ink images are disposed on the second primer image which is disposed on the surface of the print substrate coated with the first primer.

In some examples, the second primer and a/multiple LEP ink(s) may be printed on the print substrate in a multi-shot process. In a multi-shot process the second primer image and the LEP ink image(s) are formed on the photo-imaging cylinder 204 as described above for the single-shot process. However, in the multi-pass method, the second primer image is produced on the photo-imaging cylinder 204 first and then transferred from the photo-imaging cylinder 204 to the ITM 208 and then from the ITM 208 to the print substrate 210 before the LEP ink image(s) are formed on the photo-imaging cylinder 204 and transferred to the print substrate 210 via the ITM 208. In examples in which multiple colours of LEP ink are used to form the eventual image on the print substrate, each colour of LEP ink image is formed on the photo-imaging cylinder 204 and transferred to the print substrate 210 via the ITM 208 before the next LEP ink image is printed on the print substrate.

LEP Ink

The LEP ink may be any electrophotographic/electrostatic ink composition. As used herein, "electrostatic ink composition" generally refers to an ink composition, which may be in liquid form, generally suitable for use in an electrostatic printing process, sometimes termed an electrophotographic printing process. The electrostatic ink composition may include chargeable particles of a resin and a pigment/colourant dispersed in a liquid carrier, which may be as described herein.

The LEP ink, e.g. the pigmented LEP ink, may comprise an ink resin and a pigment. In some examples the LEP ink comprises an ink resin, a pigment and a non-polar carrier liquid. In some examples the LEP ink comprises a charge adjuvant. In some examples the LEP ink comprises a charge director. Examples of suitable ink resins are the ink resins described for the second primer resin. Examples, of suitable non-polar carrier liquids are the non-polar carrier liquids described above as a component of the second primer. Examples of suitable charge adjuvants are the charge adjuvants described above as possible components of the second primer. Examples of suitable charge directors are the charge directors described above as possible components of the second primer.

The LEP ink may include other additives or a plurality of other additives. The other additive or plurality of other additives may be added at any stage during the production of an LEP ink. The other additive or plurality of other additives may be selected from a charge adjuvant, a wax, a surfactant, viscosity modifiers, and compatibility additives. The wax may be an incompatible wax. As used herein, "incompatible wax" may refer to a wax that is incompatible with the resin. Specifically, the wax phase separates from the resin phase upon the cooling of the resin fused mixture on a print substrate during and after the transfer of the ink film to the print substrate, e.g. from an intermediate transfer member, which may be a heated blanket.

The LEP ink, when printed on a print substrate, may be substantially free from liquid carrier. In an electrostatic printing process and/or afterwards, the liquid carrier may be removed, e.g. by an electrophoresis processes during printing and/or evaporation, such that substantially just solids are transferred to the print substrate. Substantially free from liquid carrier may indicate that the ink printed on the print substrate contains less than 5 wt % liquid carrier, in some examples, less than 2 wt % liquid carrier, in some examples less than 1 wt % liquid carrier, in some examples less than 0.5 wt % liquid carrier. In some examples, the ink printed on the print substrate is free from liquid carrier.

In some examples, the ink resin may constitute 5% to 99% by weight of the solids in the LEP ink, in some examples 50 to 90 wt. %, in some examples 70 to 90 wt. % of the solids of the LEP ink. The remaining wt % of the solids in the ink composition may be a pigment and, in some examples, any other additives that may be present.

In some examples, the pigment constitutes a certain wt %, e.g. from 1 wt %, to 50 wt %, in some examples 1 wt %, to 30 wt % of the solids of the electrostatic ink composition, and the remaining wt % of the solids of the electrostatic ink composition is formed by the resin and, in some examples, any other additives that are present. The other additives may constitute 10 wt % or less of the solids of the electrostatic ink composition, in some examples 5 wt % or less of the solids of the electrostatic ink composition, in some examples 3 wt % or less of the solids of the electrostatic ink composition.

The LEP ink (pigmented LEP ink) includes a colourant/pigment. The colorant may be a dye or pigment. The colorant can be any colorant compatible with the liquid carrier and useful for electrophotographic printing. For example, the colorant may be present as pigment particles, or may comprise a resin (in addition to the polymers described herein) and a pigment. The resins and pigments can be any of those standardly used in the art. In some examples, the colorant is selected from a cyan pigment, a magenta pigment, a yellow pigment and a black pigment. For example, pigments by Hoechst including Permanent Yellow DHG, Permanent Yellow GR, Permanent Yellow G, Permanent Yellow NCG-71, Permanent Yellow GG, Hansa Yellow RA, Hansa Brilliant Yellow 5GX-02, Hansa Yellow X, NOVAPERM® YELLOW HR, NOVAPERM® YELLOW FGL, Hansa Brilliant Yellow 10GX, Permanent Yellow G3R-01, HOSTAPERM® YELLOW H4G, HOSTAPERM® YELLOW H3G, HOSTAPERM® ORANGE GR, HOSTAPERM® SCARLET GO, Permanent Rubine F6B; pigments by Sun Chemical including L74-1357 Yellow, L75-1331 Yellow, L75-2337 Yellow; pigments by Heubach including DALAMAR® YELLOW YT-858-D; pigments by Ciba-Geigy including CROMOPHTHAL® YELLOW 3 G, CROMOPHTHAL® YELLOW GR, CROMOPHTHAL® YELLOW 8 G, IRGAZINE® YELLOW SGT, IRGALITE® RUBINE 4BL, MONASTRAL® MAGENTA, MONASTRAL® SCARLET, MONASTRAL® VIOLET, MONASTRAL® RED, MONASTRAL® VIOLET; pigments by BASF including LUMOGEN® LIGHT YELLOW, PALIOGEN® ORANGE, HELIOGEN® BLUE L 690 IF, HELIOGEN® BLUE TBD 7010, HELIOGEN® BLUE K 7090, HELIOGEN® BLUE L 710 IF, HELIOGEN® BLUE L 6470, HELIOGEN® GREEN K 8683, HELIOGEN® GREEN L 9140; pigments by Mobay including QUINDO® MAGENTA, INDOFAST® BRILLIANT SCARLET, QUINDO® RED 6700, QUINDO® RED 6713, INDOFAST® VIOLET; pigments by Cabot including Maroon B STERLING® NS BLACK, STERLING® NSX 76, MOGUL® L; pigments by DuPont including TIPURE® R-101; and pigments by Paul Uhlich including UHLICH® BK 8200. Where the pigment is a white pigment particle, the pigment particle may be selected from the group consisting of $TiO_2$, calcium carbonate, zinc oxide, and mixtures thereof. In some examples the white pigment particle may comprise an alumina-$TiO_2$ pigment.

The colorant or pigment particle may be present in the LEP ink composition in an amount of from 10 wt % to 80 wt % of the total amount of resin and pigment, in some examples 15 wt % to 80 wt %, in some examples 15 wt % to 60 wt %, in some examples 15 wt % to 50 wt %, in some examples 15 wt % to 40 wt %, in some examples 15 wt % to 30 wt % of the total amount of resin and colorant. In some examples, the colorant or pigment particle may be present in the LEP ink in an amount of at least 50 wt % of the total amount of resin and colorant or pigment, for example at least 55 wt % of the total amount of resin and colorant or pigment.

Examples of the LEP ink(s) include any commercially available LEP ink (e.g., Electrolnk available from HP Indigo).

EXAMPLES

The following illustrates examples of the compositions and related aspects described herein. Thus, these examples should not be considered to restrict the present disclosure, but are merely in place to teach how to carry out methods and use apparatus of the present disclosure.

Example 1

CLAY COATED NEWS BACK (CCNB) (Classic Coated Recycled Board from RockTenn Mill, 457 μm thick) referred to as RockTenn CCNB was used as the print substrate.

The printing apparatus used was a HP Indigo 30000 printing system which includes an in-line gravure coating system (analogue printing station) as illustrated in FIG. 2 and described above. In the gravure coating system, an anilox 1.2 BCM was used and a rubber applicator 60 shore.

The gravure coating system was used to coat the print substrate with a first primer (DigiPrime® 050, from Michelman®)

The printing press was worked in a one shot mode. In this mode all the printing ink (HP Indigo Electrolnk 4.5) is accumulated on the intermediate blanket prior to transfer to the substrate (accumulation order on the intermediate blanked was Yellow-Magenta-Cyan-Black and HP Electrolnk primer as the second primer).

The second primer contained 58.5 wt. % (by total solids) of HP Electrolnk 4.5 colourless paste (based on ethylene methacrylic acid copolymers and ethylene acrylic acid copolymers), 40 wt. % (by total solids) of maltose monohydrate and 1.5 wt. % aluminium stearate. The second primer was obtained by grinding the HP Electrolnk 4.5 colourless paste, maltose monohydrate and aluminium stearate in the presence of the non-polar carrier fluid (Isopar L) in an attritor at 25° C. for 24 hours. The ground mixture was diluted with additional non-polar carrier liquid to a solids content ranging from about 2% (w/w) to about 3% (w/w). The second primer was charged by adding a charge director (Imaging Agent from HP).

Figure 4A:
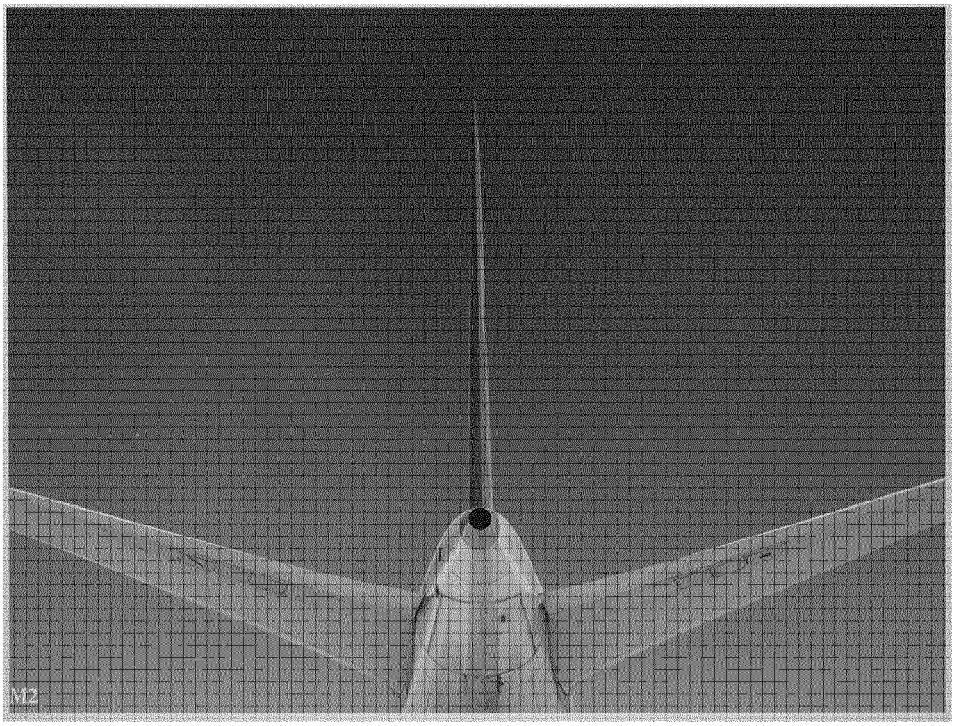
FIG. 4*a* is an example of an image printed according to Example 1.

An image printed after 11000 prints produced using this method is shown in FIG. 4*a*

Comparative Example 1

An image was printed as for Example 1, except that no second primer was applied to the print substrate before the LEP ink image was applied to the surface of the print substrate coated with the first primer.

Figure 4B:
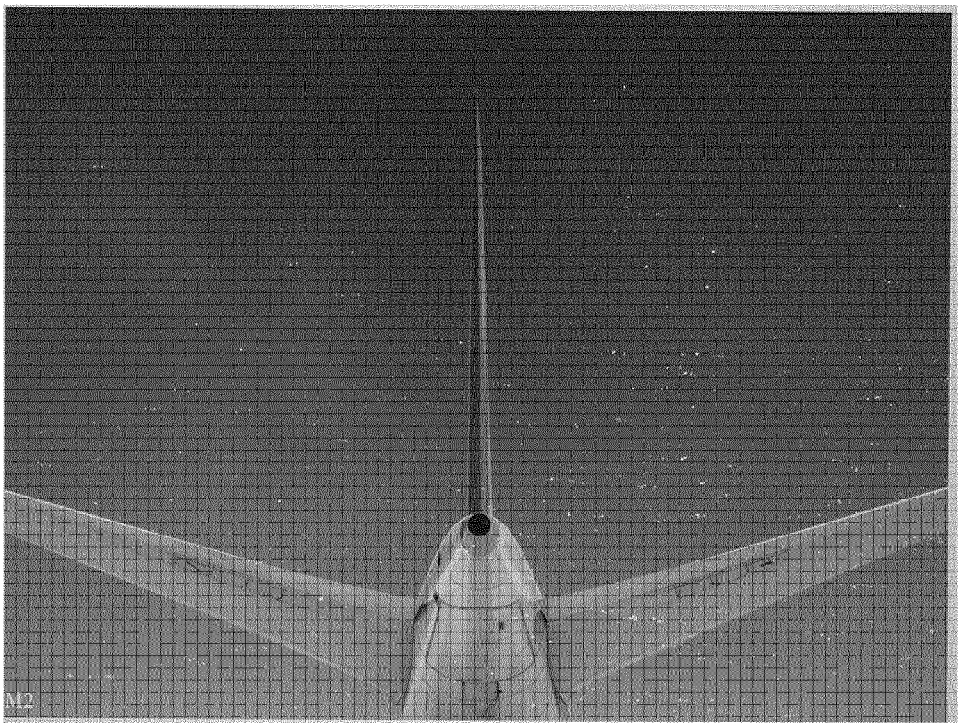
FIG. 4*b* is an example of an image printed according to Comparative Example 1.

An image printed after 11000 prints produced according to Comparative Example 1 is shown in FIG. 4*b*. A number of defects are visible in the images printed according to Comparative Example 1, as shown in for example FIG. 4*a*. The defects in these images are due to problems in transfer of the LEP ink to the print substrate. It was also observed that the number of defects in the images produced according to Comparative Example 1 increases with the number of prints.

The images produced according to the method of Example 1, for example as shown in FIG. 4*a*, appear to be substantially defect free which indicates that the transfer of LEP ink to the print substrate is greatly improved by using a method in which a first primer is coated onto a surface of the print substrate using an analogue printing technique and then a second primer is digitally printed onto the surface of the print substrate coated with the first primer before an LEP ink is printed onto the print substrate.

Example 2

Example 1 was repeated except that a solid cyan image (LEP ink—cyan Electrolnk 4.5) was printed on the primed print substrate instead of a CMYK image.

Figure 5A:
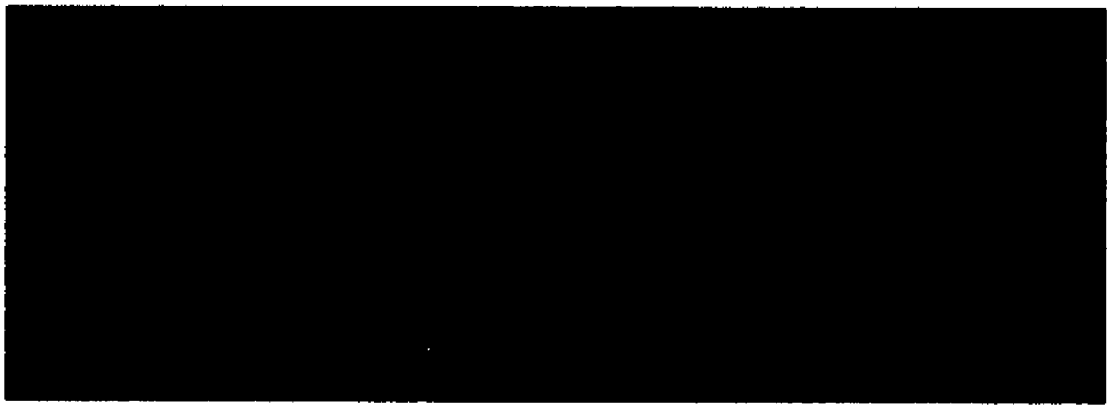
FIG. 5*a* is an example of an image printed according to Example 2.

An image printed after 11000 prints produced using this method is shown in FIG. 5*a*

Comparative Example 2

Comparative example 1 was repeated except that a solid cyan image (LEP ink—cyan Electrolnk 4.5) was printed on the primed print substrate instead of a CMYK image.

Figure 5B:
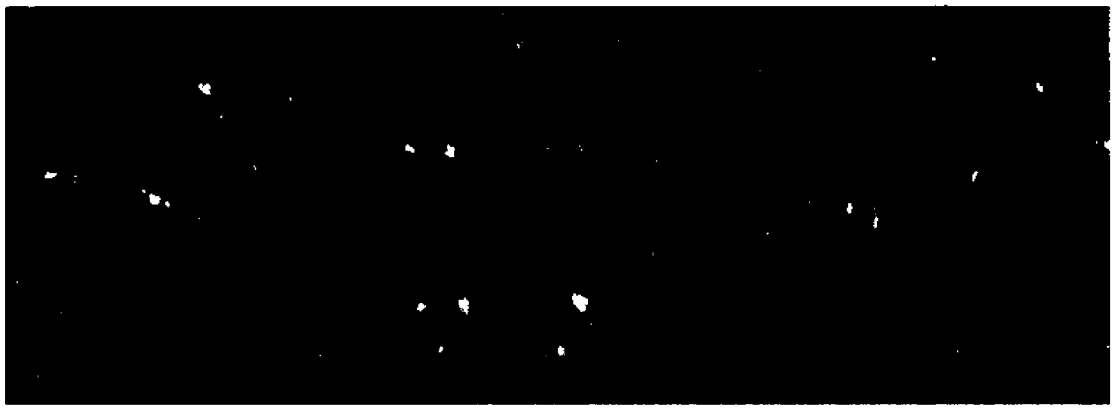
FIG. 5*b* is an example of an image printed according to Comparative Example 2.

An image printed after 11000 prints produced using this method is shown in FIG. 5*b*

Example 3

Example 1 was repeated except that a solid magenta image (LEP ink—magenta Electrolnk 4.5) was printed on the primed print substrate instead of a CMYK image.

Figure 6A:
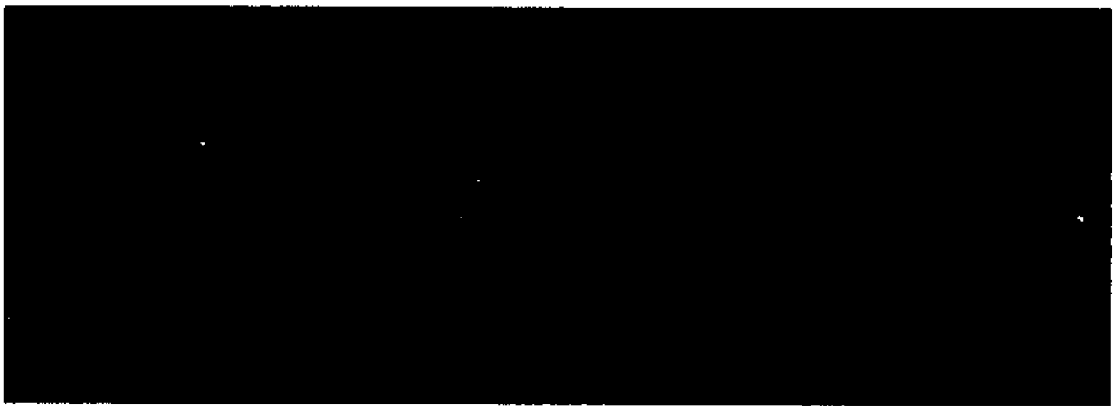
FIG. 6*a* is an example of an image printed according to Example 3.

An image printed after 11000 prints produced using this method is shown in FIG. 6*a*

Comparative Example 3

Comparative example 1 was repeated except that a solid magenta image (LEP ink—magenta Electrolnk 4.5) was printed on the primed print substrate instead of a CMYK image.

Figure 6B:
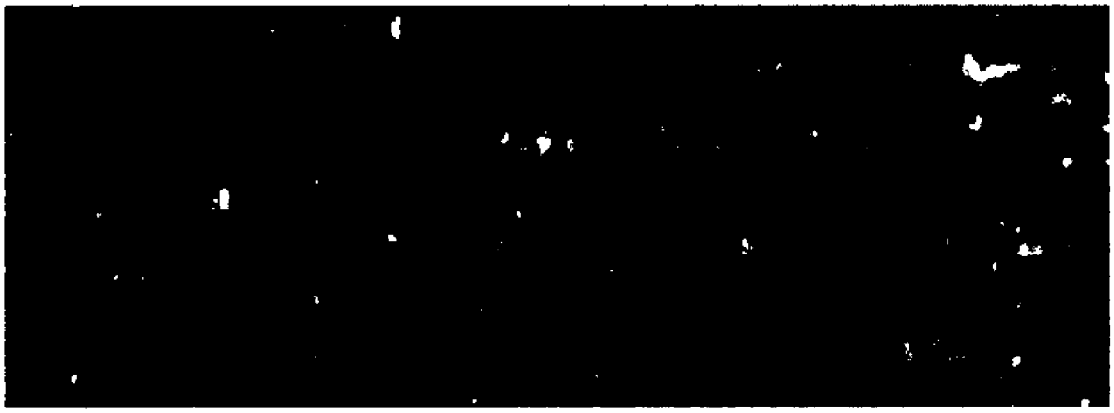
FIG. 6*b* is an example of an image printed according to Comparative Example 3.

An image printed after 11000 prints produced using this method is shown in FIG. 6*b*

Figure 7:
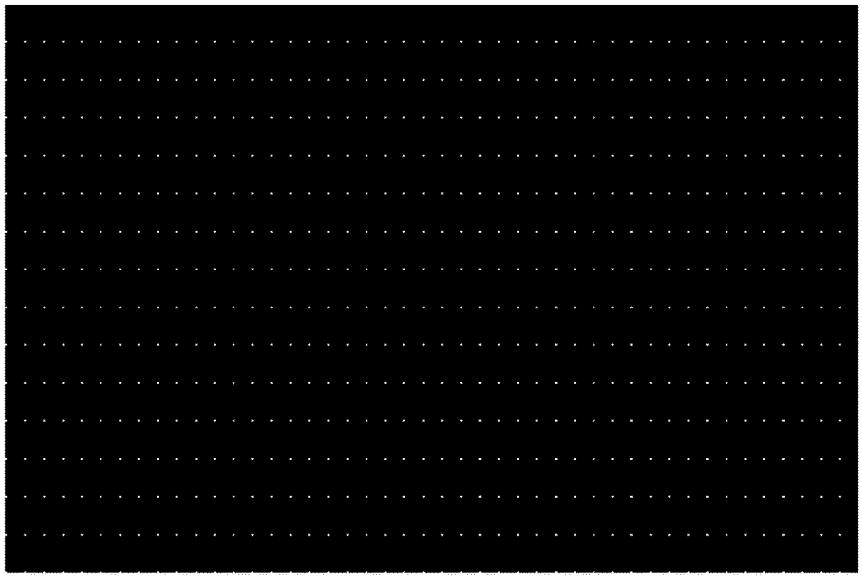
FIG. 7 is a synthetic image of an example of an image printed according to Comparative Example 3.

The images printed after 11000 prints produced according to Examples 2 and 3 and Comparative Examples 2 and 3, as shown in FIGS. 5*a*-6*b*, were scanned using CanoScan 9000F from Canon using 300 dpi resolution. The scanned images were processed using Adobe Photoshop software. The colored images were transformed into binary mode (black and white). And the amount of missing ink was determined as shown in table 1. As seen, the amount of ink missing appears to be small from first sight. The synthetic image shown in FIG. 7 (created artificially using Adobe Photoshop software to show a solid patch of colour with 0.5% of the solid missing) demonstrates how the human eye perceives 0.5% of missing data on a black image.

TABLE 1

| Printed substrate produced according to | Amount missing LEP ink in image formed on printed substrate [%] |
|---|---|
| Example 2 | <0.005 |
| Example 3 | 0.02 |
| Comparative Example 2 | 0.2 |
| Comparative Example 3 | 0.5 |

Figure 8:
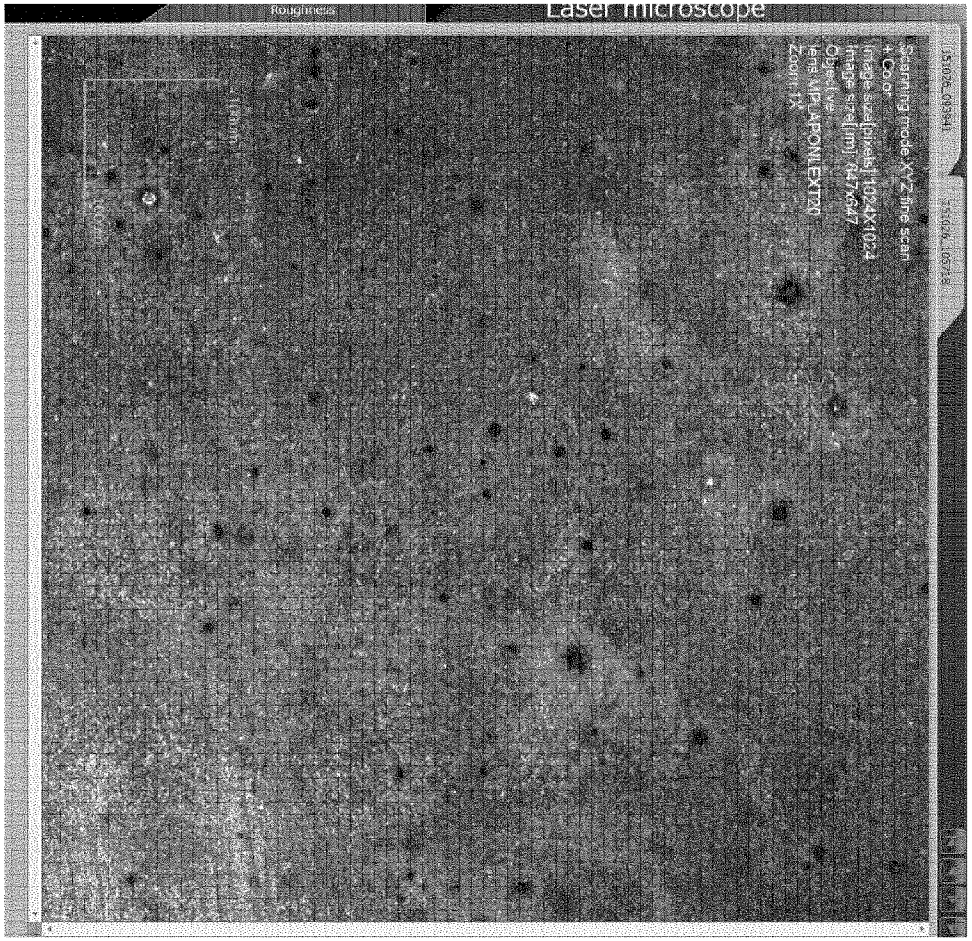
FIG. 8 is a confocal microscope image of the surface of an example of a print substrate.

The surface of RockTenn CCNB substrate used in the Examples and Comparative Examples was investigated using a confocal microscope (LEXT 3D measuring laser microscope OLS 4000 from Olympus). A typical surface image is shown in FIG. 8. The image reveals that the RockTenn CCNB substrate contains holes. The holes in the substrate were analysed and from this analysis using the data collected using the confocal microscope the holes substrate density was estimated to be about 120 holes per square mm, the average hole diameter was found to be about 7 μm and the average hole depth was found to be about 7 μm.

The present inventors have also found that the claimed invention provides for improved ink transfer to the print substrate than either printing on a substrate coated with only a first primer as described herein or printing on a substrate printed with a only second primer as described herein.

While the methods, printing apparatus and related aspects have been described with reference to certain examples, it will be appreciated that various modifications, changes, omissions, and substitutions can be made without departing from the spirit of the disclosure. It is intended, therefore, that the methods, printing apparatus and related aspects be limited only by the scope of the following claims. Unless otherwise stated, the features of any dependent claim can be combined with the features of any of the other dependent claims, and any other independent claim.

The invention claimed is:

1. A method for priming a print substrate for subsequently receiving a liquid electrophotographic (LEP) ink, the method comprising:

coating a surface of a print substrate with a first primer using an analogue printing technique, wherein the first primer includes a first primer resin dissolved or dispersed in a polar carrier liquid; and digitally printing a second primer to the surface of the print substrate coated with the first primer such that the second primer is disposed on the first primer, wherein the second primer includes a non-polar carrier liquid.

2. The method according to claim 1, wherein the second primer comprises a second primer resin and a solid polar compound, wherein the solid polar compound is selected from the group consisting of a cellulose microcrystalline powder, dextrin, maltose monohydrate, polyacrylic acid, polyvinyl alcohol, a styrene maleic anhydride copolymer, a bismaleimide oligomer, sucrose, sucrose octaacetate, sucrose benzoate, and combinations thereof.

3. The method according to claim 2, wherein the second primer further comprises a charge adjuvant.

4. The method according to claim 2, wherein the second primer further comprises a charge director.

5. The method according to claim 1, wherein the second primer comprises:

a paste comprising:

the non-polar carrier liquid; and a second primer resin swollen in the non-polar carrier liquid, the second primer resin present in the paste in an amount ranging from about 20% (w/w) to about 50% (w/w); and a solid polar compound dispersed in the resin, the solid polar compound being selected from the group consisting of a cellulose microcrystalline powder, dextrin, maltose monohydrate, polyacrylic acid, polyvinyl alcohol, a styrene maleic anhydride copolymer, a bismaleimide oligomer, sucrose, sucrose octaacetate, sucrose benzoate, and combinations thereof, and the solid polar compound being present in an amount up to 60 wt. % of solids in the paste.

6. The method according to claim 1, wherein the first primer resin is selected from the group consisting of a polyvinyl alcohol resin, a cellulose based resin, a polyethylene imine resin, a copolymer of an alkylene monomer and an acrylic or methacrylic acid monomer, a polyacrylic polymer, and a combination thereof.

7. The method according to claim 1, wherein the first primer resin includes a copolymer of ethylene and acrylic acid.

8. The method according to claim 1, wherein coating a surface of a print substrate with a first primer using an analogue printing technique comprises flood coating the surface of the print substrate with the first primer to coat the entire surface of the print substrate.

9. The method according to claim 1, wherein digitally printing a second primer to the surface of the print substrate coated with the first primer comprises selectively applying the second primer to the print substrate.

10. The method according to claim 9, wherein selectively applying the second primer to the print substrate comprises applying the second primer to areas of the print substrate to which a LEP ink image is to be subsequently printed.

11. The method according to claim 1, wherein digitally printing a second primer to the surface of the print substrate coated with the first primer comprises liquid electrophotographically printing the second primer to the print substrate.

12. The method according to claim 1, wherein the print substrate is cardboard.

13. A printing apparatus comprising:

an analogue printing station for coating a surface of a print substrate with a first primer, wherein the first primer includes a first primer resin dissolved or dispersed in a polar carrier liquid; and a liquid electrophotographic (LEP) printing station for liquid electrophotographically printing a second primer to the surface of the print substrate coated with the first primer, wherein the second primer includes a non-polar carrier liquid, wherein the LEP printing station comprises:

a reservoir containing the second primer; and a photoconductive member having a surface on which a latent electrostatic image can be created, and wherein the printing apparatus is configured to print the second primer to the surface of the print substrate coated with the first primer such that the second primer is disposed on the first primer on the print substrate.

14. The printing apparatus according to claim 13, wherein the analogue printing station comprises a gravure printing system, the analogue printing station being in-line with the LEP printing station.

15. A printing method comprising:

priming a print substrate to receive a LEP ink image; and liquid electrophotographically printing a pigmented liquid electrophotographic (LEP) ink image on to the primed print substrate, wherein priming comprises:

coating a surface of the print substrate with a first primer using an analogue printing technique, wherein the first primer includes a first primer resin dissolved or dispersed in a polar carrier liquid;

drying the print substrate coated with the first primer; and digitally printing a second primer to the surface of the print substrate coated with the first primer such that the second primer is disposed on the dried first primer to provide a primed print substrate, wherein the second primer includes a non-polar carrier liquid, and wherein the pigmented LEP ink image is printed to be disposed on the second primer on the print substrate.

16. The printing method according to claim 15, wherein digitally printing a second primer to the surface of the print substrate coated with the first primer comprises liquid electrophotographically printing the second primer to the print substrate.

* * * * *